US006024352A

United States Patent [19]

Albrecht

[11] Patent Number: 6,024,352

[45] Date of Patent: Feb. 15, 2000

[54] MACHINE VISE

[75] Inventor: Ludwig Albrecht, Oberstaufen, Germany

[73] Assignee: Saurer-Allma GmbH, Kempten, Germany

[21] Appl. No.: 09/150,682

[22] Filed: Sep. 10, 1998

[30] Foreign Application Priority Data

Sep. 20, 1997 [DE] Germany ..... 197 41 587

[51] Int. Cl.[7] ..... B25B 1/00

[52] U.S. Cl. ..... 269/244; 269/251; 269/285

[58] Field of Search ..... 269/244, 250, 269/251, 285

[56] References Cited

U.S. PATENT DOCUMENTS

| | | | |
|---|---|---|---|
| 2,499,124 | 2/1950 | Zipp et al. . | |
| 4,932,643 | 6/1990 | Rohm | 269/244 |
| 5,163,662 | 11/1992 | Bernstein | 269/244 |

FOREIGN PATENT DOCUMENTS

| | | |
|---|---|---|
| 3438900 | 4/1986 | Germany . |
| 8904106 | 6/1989 | Germany . |
| 3929511 | 3/1991 | Germany . |
| 4111430 | 10/1991 | Germany . |

OTHER PUBLICATIONS

Leaflet of Firma FIPA GmbH, Industrie–Ausrustungen, Feb. 1997, Germany, pp. 22 and 23.

*Primary Examiner*—Robert C. Watson
*Attorney, Agent, or Firm*—Jacobson, Price, Holman & Stern PLLC

[57] ABSTRACT

A machine vise has lateral cuttings outlets (10). Two wipers are provided on the slide (6). The first wiper (7) cooperates with the surface of a cylindrical region (2) of the spindle (1). The second wiper (8) clears the cuttings from the thread (4) of the spindle (1).

12 Claims, 5 Drawing Sheets

MACHINE VISE

BACKGROUND OF THE INVENTION

The invention relates to a machine vise having a base body and a slide which is driven by way of a screw spindle, the base body and the slide, which accommodates the screw spindle in a bore, each carrying a clamping jaw, the slide being arranged in an upwardly open cutout of the base body and being movable there in guide rails.

A machine vise of the type above-described is disclosed in, for example, DE-A1-3438900. Such a machine vise serves, for example, to clamp workpieces firmly on the machining table of a machine tool, so that the workpiece can be machined.

During machining operations, e.g. turning, milling or drilling, large amounts of cuttings or shavings are produced and these are deposited in the region of the machine vise and the workpiece. These cuttings are very disruptive during a change of workpiece. It is necessary to clean the mounting surface and also the vise thoroughly, to prevent cuttings or the like from getting into the clamping surfaces or into the thread of the screw spindle of the vise. These cuttings could lead to jamming or blocking.

It is known to close the unavoidable gap between the clamping jaws of the machine vise and the drive of the clamping jaws, i.e. the screw spindle, by means of covers. However, this only partially solves the problem. In the case of varying clamping lengths, the covers must be adapted to the specific requirements of each. Handling of the covers is time-consuming.

An object of the present invention is to further develop a machine vise of the type described above such that any disruptions due to cuttings or the like are totally or largely reduced, thereby increasing operating time and productivity.

BRIEF SUMMARY OF THE INVENTION

This and other objects of the invention are achieved in the invention by the provision of a machine vise having a base body and a slide which is driven by way of a screw spindle, the base body and the slide, which accommodates the screw spindle in a bore, each carrying a clamping jaw, the slide being arranged in an upwardly open cutout of the base body and being movable there in guide rails, wherein the spindle has a cylindrical region and a threaded region, which are of approximately the same length and also correspond at least approximately to the length of the slide bore, wherein the slide has at each end an annular wiper cooperating with the spindle and wherein the base body has at least one lateral, elongated outlet for cuttings which is disposed adjacent the cylindrical region of the spindle.

The arrangement according to the invention results in the region of the spindle between the clamping jaws being largely covered, namely by an appropriate design of the slide itself. If desired, a tube which completely accommodates the screw spindle may also be attached to the slide. However, since this would lead to an increase of the overall length, it is generally not employed, as the wiper alone may be capable of keeping the thread sufficiently clean.

DETAILED DESCRIPTION OF THE INVENTION

It is essential to the invention that the base body has at least one lateral, elongated cuttings outlet, so that cuttings falling down from the workpiece and coming into the region of the covered spindle can escape from the machine vise.

This transport of the cuttings can be effected in various ways. The drilling fluid may be used for this purpose. It is also possible, however, to remove the cuttings by means of compressed air. Mechanical means may also be employed. The position of the cuttings outlets facilitates the removal of the cuttings considerably in this procedure.

When reference is made, in the context of the invention, to "lateral" cuttings outlets or to an "upwardly" open cutout of the base body, in which cutout the spindle is arranged, this definition of the invention assumes that the machine vise is arranged on a plane, horizontal surface. In special cases, however, it may be desirable to use the machine vise, for example, on vertical columns. The construction according to the invention may be utilized advantageously in this application too, although in this case the cutout in the base body, which cutout accommodates the spindle, is laterally open.

The same applies when, although the machine vise is mounted on a vertical surface, the spindle is oriented substantially horizontally.

It is favourable for a cuttings outlet to be arranged on each side of the base body. This enlarges the area for cuttings discharge. A cuttings outlet may also be provided in the bottom of the base body, in which case it is important of course for the mounting surfaces to have corresponding openings to allow the cuttings to pass through.

It has been found that considerable advantages are achieved if a cuttings wiper which cooperates with the underside of the slide and bounds the region of the elongated cuttings outlets is arranged on the bottom of the base body. This cuttings wiper, which is preferably designed with a V-shaped configuration, directs the cuttings towards the cuttings outlets and reduces the possibility of their being conveyed into the region of the spindle having the thread.

It is particular favourable if the V-shaped cuttings wiper cooperates with plane surfaces at the underside of the slide. Such surfaces are easy to machine and they also prevent any significant entrainment of the cuttings by the slide owing to the movement thereof. In this case, it is favourable if the dimensions of the slide under the spindle are small, to avoid entrainment and compression of the cuttings in the region of the cuttings outlets by the slide during the movement thereof.

The discharge of cuttings through the cuttings outlets mentioned is improved if the lower boundary of the elongated, lateral cuttings outlets is arranged substantially in the plane of the upper surface of the bottom of the base body. A plane surface which does not allow attachment of the cuttings is thus obtained under the spindle. The cuttings do not find any hold and can easily be blown or flushed out, for example.

The first wiper, which cooperates with the cylindrical part of the spindle, preferably has a wiping lip, thereby virtually precluding the penetration of cuttings into the slide bore, which accommodates and encloses the spindle.

The second wiper is preferably adapted to the thread shape of the spindle, that is to say in particular engages partially in the turns and cleans the thread before this part of the spindle comes into contact with the spindle nut. In particular, the invention proposes that this second wiper is attached directly to the threaded nut.

It has been found that there is a favourable effect on the stability of the machine vise, in particular the base body, if the guide rails are arranged between the base body and the slide, above the mid-plane of the spindle and the cuttings outlets are arranged below this mid-plane.

In the preferred embodiment of the invention, it is provided that the cylindrical region of the spindle is arranged between the threaded region and the spindle drive.

DETAILED DESCRIPTION OF PREFERRED EMBODIMENTS

Figure 1:
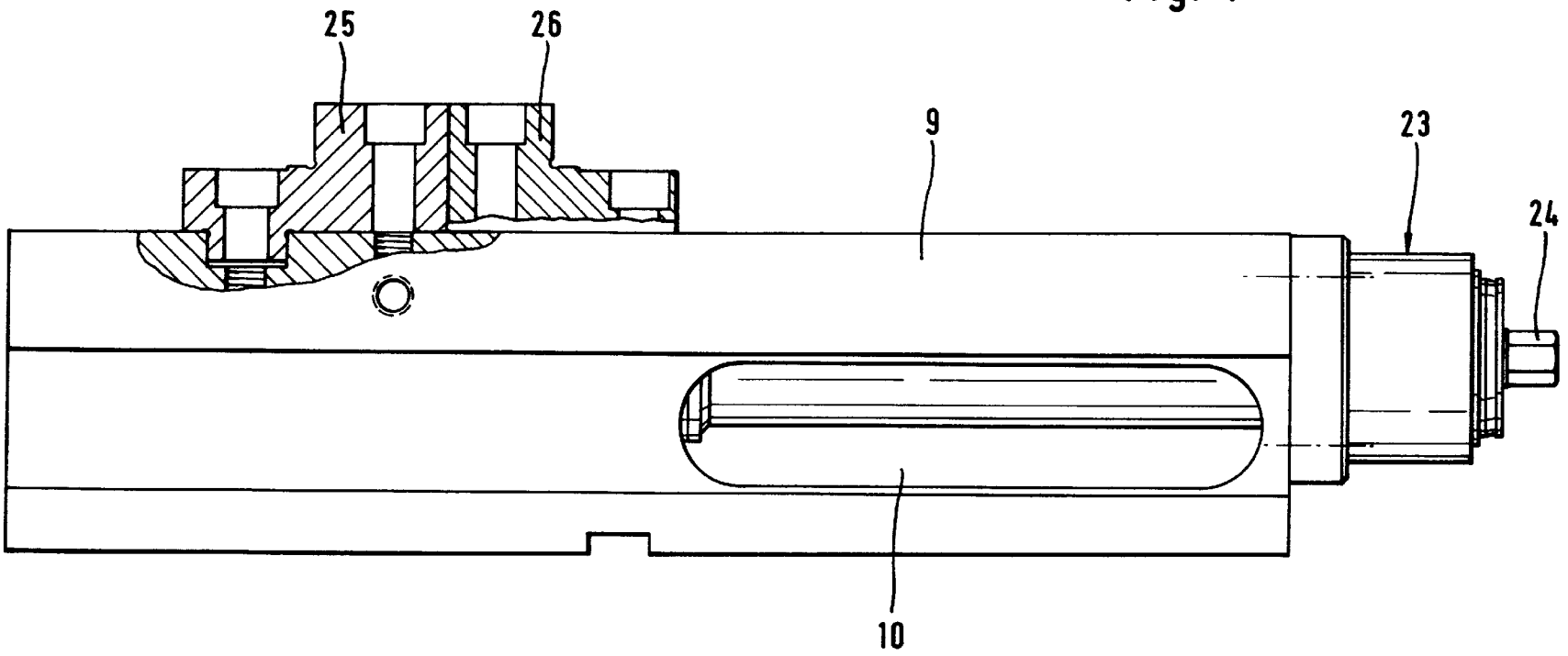
FIG. 1 shows a side view of a machine vise according to the invention.
Figure 7:
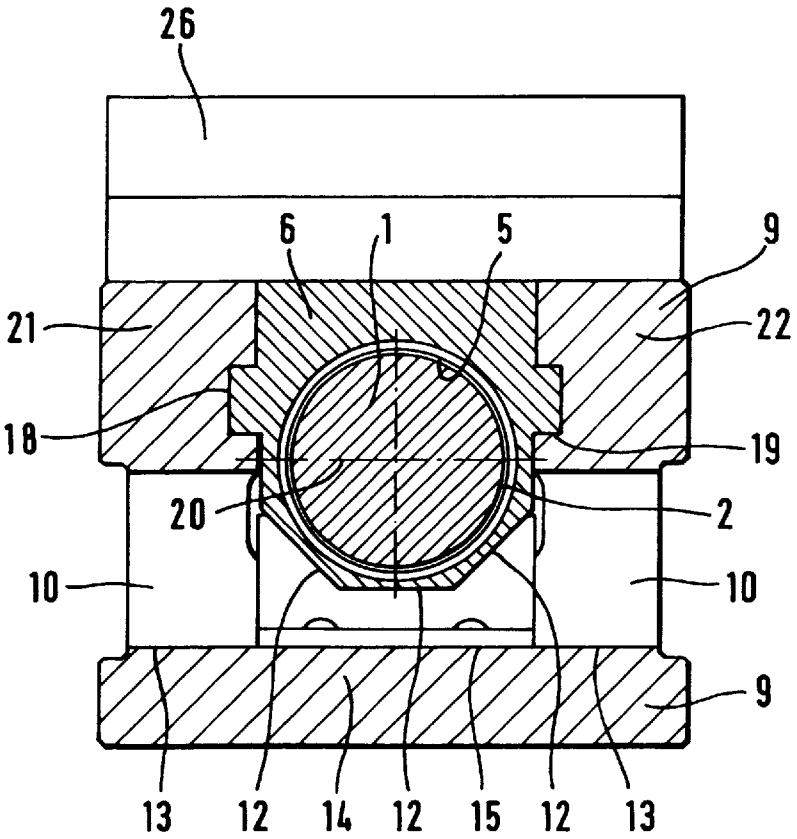
FIG. 7 shows a section through the representation of FIG. 4, on the line VII—VII.
Figure 6:
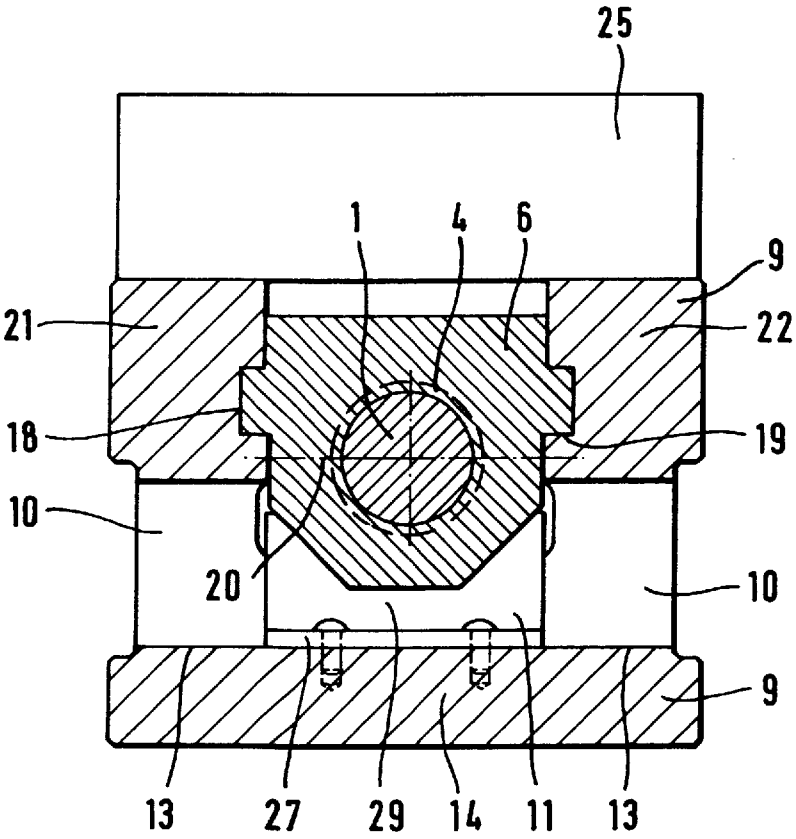
FIG. 6 shows a section through the representation of FIG. 4, on the line VI—VI

Referring first to FIG. 1, the machine vise shown consists essentially of a base body 9, which has an approximately U-shaped configuration, as is apparent from the representations of FIGS. 6 and 7. As a result, the base body encloses a slide 6, which can be moved by means of a spindle 1. A spindle drive 23 has a polygonal piece 24. Using a suitable crank, it is possible to rotate the spindle 1 by way of a power assist, which is not shown specifically. The spindle 1 has two regions, namely a region 2 having essentially a cylindrical outer surface and a region 3 with a thread 4.

Figure 2:
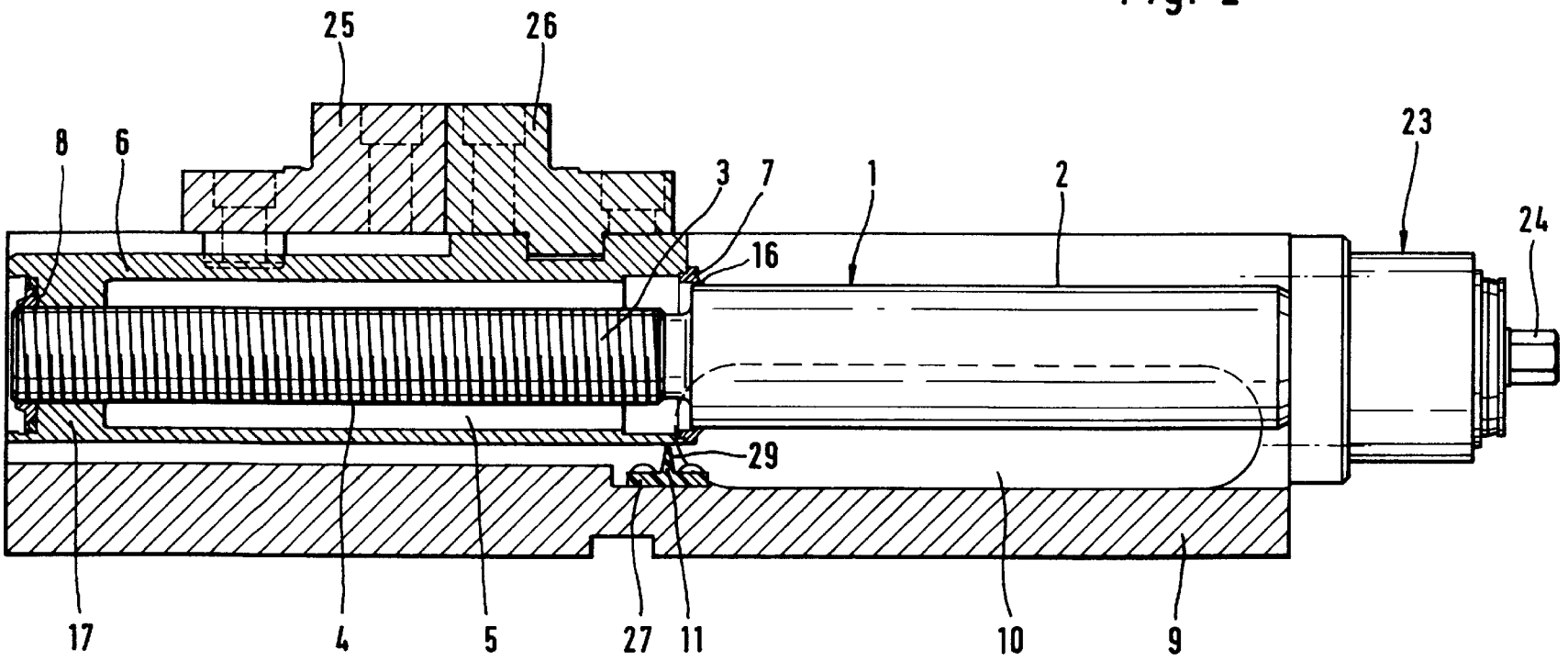
FIG. 2 shows a longitudinal section through the machine vise in the position according to FIG. 1.

A spindle nut 17 is part of the slide 6 and engages on the spindle 1 in the region 3. In the position of FIGS. 1 and 2, the region 3 extends into the slide bore 5, which therefore encloses the spindle, while the smooth region 2 is visible from above.

Figure 4:
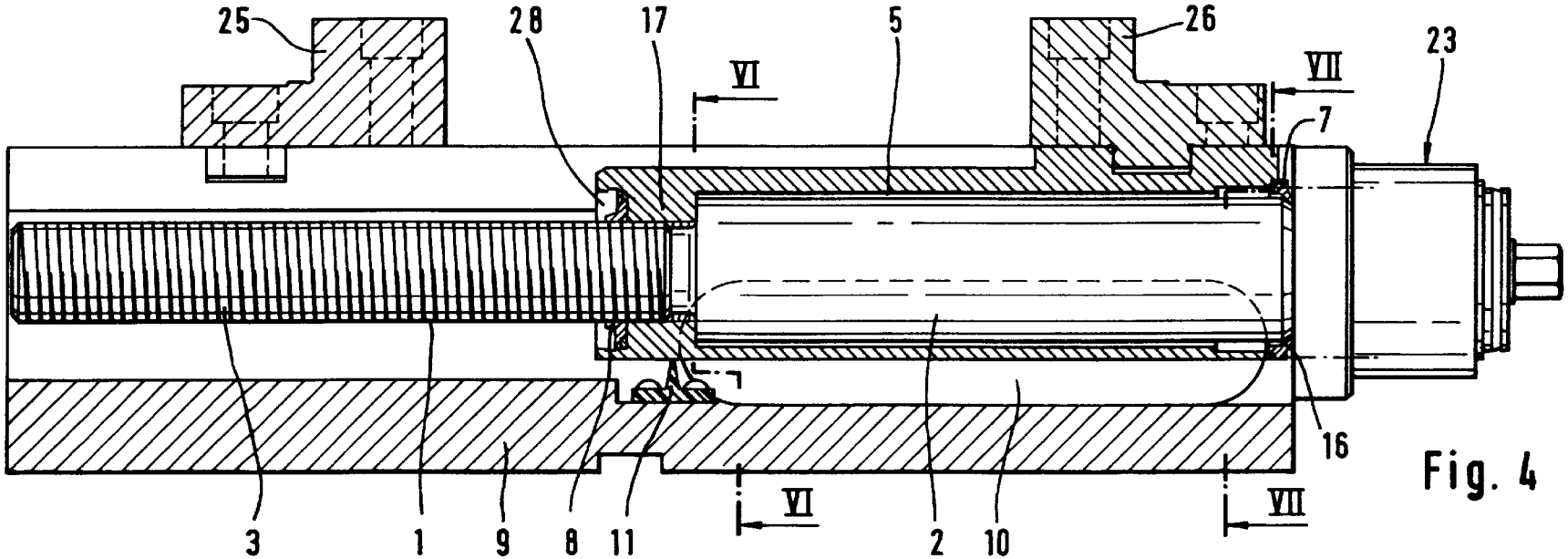
FIG. 4 shows a longitudinal section through the machine vise in the position according to FIG. 3.

In the position of FIG. 4, in contrast, the region 2 extends into the slide bore 5, while the region 3 projects out of the slide at the end remote from the spindle drive 23. If desired, this region 3 may also be covered by an additional sleeve.

Figure 3:
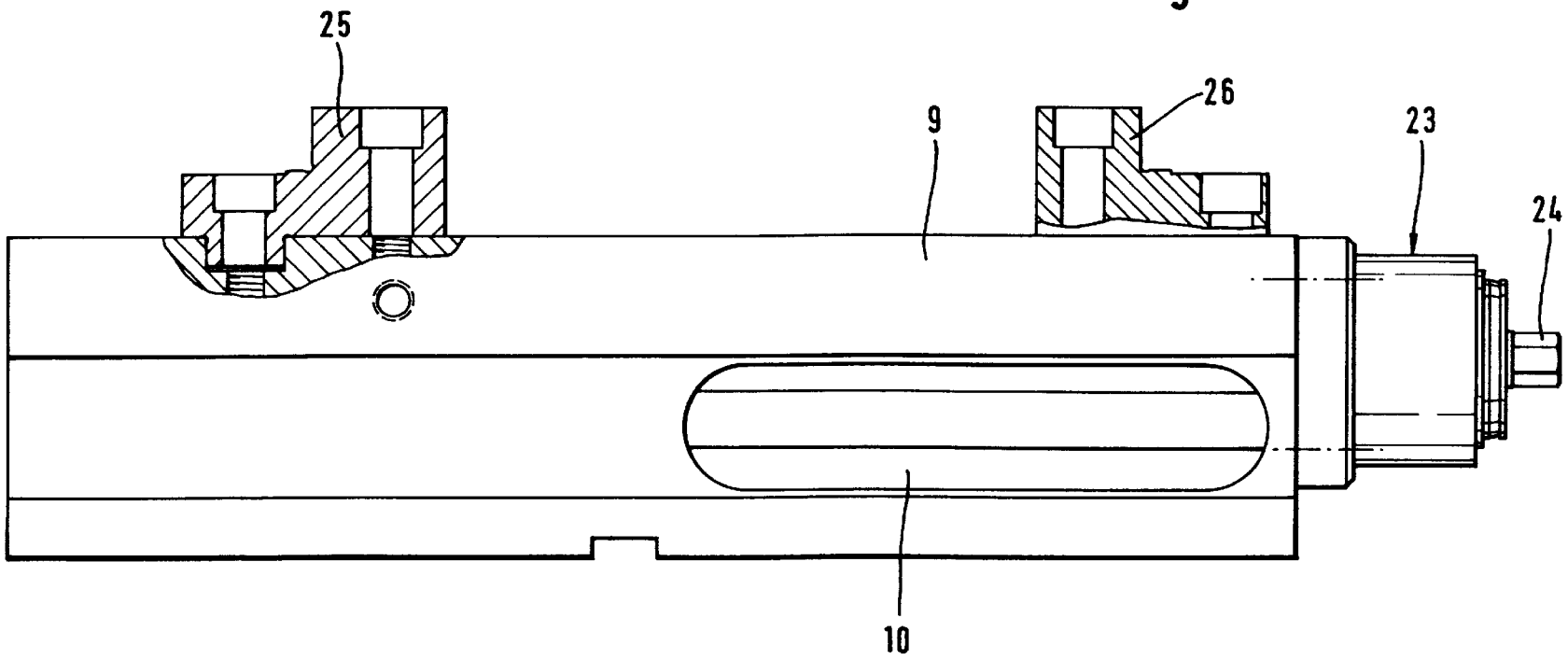
FIG. 3 shows a view of the machine vise according to FIGS. 1 and 2 in a different operating position.
Figure 5:
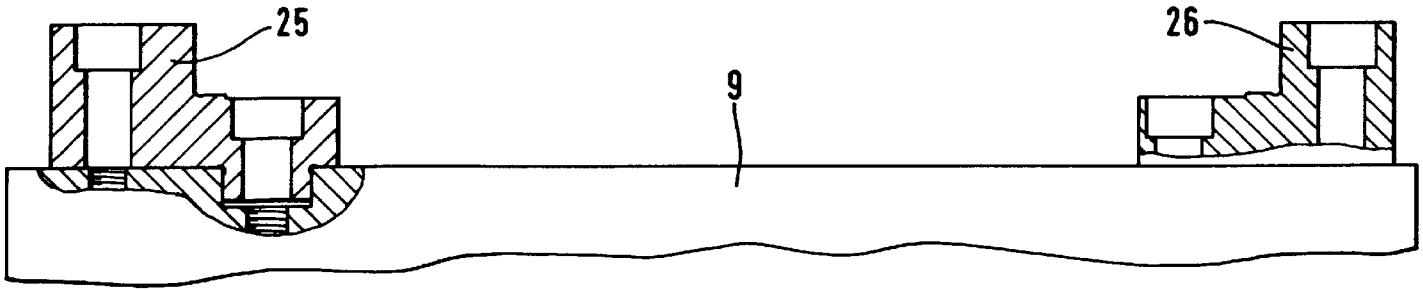
FIG. 5 shows a variant on the representation of FIGS. 3 and 4 with a different arrangement of the jaws.

Two clamping jaws are arranged on the machine vise, namely a clamping jaw 25 which is fixedly mounted on the base body, and a clamping jaw 26 which is connected to the slide and is thereby displaceable from the position of FIG. 1 into the position of FIG. 3. Each of the clamping jaws 25 and 26 may, if desired, also be transposed (cf. FIG. 5), thereby enabling the clamping range of the machine vise to be altered, and in particular to be enlarged. The clamping jaws are fastened by means of screws (not shown).

As is apparent in particular from the representations of FIGS. 6 and 7, outlets 10 for cuttings are provided in the side parts 21 and 22 of the base body 9, the lower boundary 13 of these outlets lying in one plane with the upper surface 15 of the bottom 14 of the base body. It is clear that cuttings lying on the surface 15 can thus easily be removed laterally through the openings 10.

As is apparent, for example from FIG. 2, the lateral cutting outlets 10 extend approximately over the region 2 of the spindle 1.

In order to prevent the cuttings from penetrating in particular into the space below the clamping jaw 25, a V-shaped cuttings wiper 11 is provided on the bottom 14 of the base body. This cuttings wiper has a base plate 27 for the purpose of fastening it to the bottom 14. The cuttings wiper 11 is provided, for example, with a wiping element 29, the upper edge of which cooperates with the surfaces 12 of the slide 6. In order to achieve reliable cooperation and also simple producibility of these surfaces, said surfaces are designed with a plane configuration. When the slide is moved to the left from the position of FIG. 4, the wiper will retain any cuttings and facilitate and promote their discharge through the openings 10. If cuttings or other impurities fall into the base body to the left of the wiper 11, the slide 6 will convey these cuttings to the left, i.e. to the end of the machine vise remote from the spindle drive.

Close to the spindle nut 17, the slide 6 has a wiper 8 in a recess 28. This wiper is adapted to the shape of the thread 4 of the spindle and prevents cuttings from getting into the region of the spindle nut 17.

A wiper 7 is likewise provided at the end of the slide 6 assigned to the drive. This wiper 7 has a lip 16 which slides along the outer surface of the region 2 of the spindle 1 when the slide is moved.

The first wiper 7 and the second wiper 8 keep the bore 29 of the spindle 1 virtually free of cuttings.

From FIGS. 6 and 7 it can be seen that guide rails 18 and 19 are arranged between the base body 9 and the slide 6, above the mid-plane 20 defined by the spindle 1. In contrast, the cuttings outlets are situated below this mid-plane 20.

The arrangement provided ensures stable guidance of the slide 6, although the cuttings outlets 10 give rise to a reduction of the section modulus and also of the moment of inertia in the base body 9. However, the disadvantageous effects of the cuttings outlets 10 are very slight in this respect. It has been found that the slight changes in position of the workpiece which are unavoidable during the clamping operation can be at least partially compensated for by the described arrangement of the openings.

Although the invention has been described in terms of specific embodiments which are set forth in considerable detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A machine vise comprising:

a base body;

a slide arranged in an upwardly open cut-out in said base body; a screw spindle which is accommodated within a slide bore in said slide, and by which said slide is driven;

guide rails on which said slide is moveable;

first and second clamping jaws carried respectively on the base body and the slide;

wherein said spindle has a cylindrical region and a threaded region, said cylindrical region and said threaded region being of approximately equal length and corresponding at least approximately to the length of said slide bore;

and wherein said slide is provided at each end thereof with an annular wiper which cooperate with said spindle;

and wherein said base body is provided with at least one lateral, elongated cuttings outlet which is disposed adjacent said cylindrical region of said spindle.

2. A machine vise as claimed in 1, wherein a cuttings outlet is arranged on each side of said base body.

3. A machine vise as claimed claim 1, wherein a cuttings outlet is arranged in the bottom of said base body.

4. A machine vise as claimed in claim 1, wherein a cuttings wiper which cooperates with the underside of said slide and bounds said cuttings outlet is arranged on the bottom of said base body.

5. A machine vise as claimed in claim 4, wherein said cuttings wiper in said base body has a V-shaped configuration.

6. A machine vise as claimed in claim 4, wherein a cuttings wiper which cooperates with the underside of said slide and bounds said cuttings outlet is arranged on the bottom of said base body and said V-shaped cuttings wiper cooperates with plane surfaces at the underside of said slide.

7. A machine vise as claimed in claim 1, wherein said lateral elongated cuttings outlet has a lower boundary which is arranged substantially in the plane of the upper surface of the bottom of said base body.

8. A machine vise as claimed in claim 1, wherein a first of said wipers cooperates with said cylindrical region of said spindle and has a wiping lip.

9. A machine vise as claimed in claim 1, wherein a second of said wipers is adapted to said thread shape of the spindle.

10. A machine vise as claimed in claim 9, wherein said second of said wipers is attached directly to a spindle nut.

11. A machine vise as claimed in claim 1, wherein said guide rails are arranged between said base body and said slide, above the mid-plane of said spindle and said cuttings outlet is arranged below said mid-plane.

12. A machine vise as claimed in claim 1, wherein said cylindrical region of said spindle is arranged between said threaded region and a drive means for said spindle.

* * * * *